United States Patent [19]

Lindberg et al.

[11] 4,361,463

[45] Nov. 30, 1982

[54] METHOD IN THE PRODUCTION OF DISSOLVING PULP

[75] Inventors: Erik A. S. Lindberg; Karl-Johan Ljungqvist, both of Skoghall, Sweden

[73] Assignee: Billerud Uddeholm Aktiebolag, Säffle, Sweden

[21] Appl. No.: 232,295

[22] Filed: Feb. 6, 1981

Related U.S. Application Data

[63] Continuation-in-part of Ser. No. 82,930, Oct. 9, 1979, abandoned.

[51] Int. Cl.[3] ..... D21C 9/00

[52] U.S. Cl. ..... 162/9; 162/13; 162/26; 162/90

[58] Field of Search ..... 162/24, 25, 26, 86, 162/90, DIG. 5, 9, 13; 81/125; 536/101

[56] References Cited

U.S. PATENT DOCUMENTS 1,857,100 5/1932 McCormick et al. ..... 8/125

3,915,959 10/1975 Goheen et al. ..... 162/90

*Primary Examiner*—William F. Smith

*Attorney, Agent, or Firm*—Murray and Whisenhunt

[57] ABSTRACT

A process for producing a highly qualified dissolving pulp sheet is disclosed, wherein the pulp sheet exhibits reduced swelling tendencies and improved mercerizing properties, combined with at least reduced need for dialysis of the mercerization liquor in any subsequent viscose processing, while reducing the energy consumption in the treatment process. A substantial proportion of the hemicellulose in a pre-hydrolyzed bleached sulfate cellulosic pulp is removed by contacting the pulp with an aqueous solution of sodium hydroxide. The pulp is subjected to mechanical working under a net energy supply of 15–100 KWh/ton pulp to split the primary layer, and at least the outer parts of the secondary layer, of the pulp fibers substantially without fibrillation. The pulp can be washed, dried and pressed to form sheets.

The dissolving pulp produced by this process is suitable for the production of reinforcing cord, such as tire cords and the like.

8 Claims, 4 Drawing Figures

METHOD IN THE PRODUCTION OF DISSOLVING PULP

This application is a continuation-in-part of Ser. No. 082,930, filed Oct. 9, 1979 now abandoned.

FIELD OF INVENTION

This invention relates to a method of treating cellulosic pulp. More particularly the invention relates to a method of treating cellulosic pulp for the production of highly qualified dissolving wood pulp. Examples of such dissolving pulps are in the first place viscose cellulose pulp for the production of reinforcing cord for rubber-products, such as tires, conveying-belts, driving-belts, and the like. An other example is dissolving pulps for the production of such products as acetate silk and acetate film.

BACKGROUND OF THE INVENTION

For the production of highly qualified dissolving pulp there is usually used pre-hydrolized, bleached sulphate pulp. Different bleaching procedures give their specific advantages and draw-backs. If only a certain number of the bleaching steps, including chlorination, alkali extraction, chloride dioxide bleaching, or hypochlorite bleaching is used there is obtained a standard cord pulp, the R18-value of which has an average who will reach about 96–97%. If the purpose is to produce a cord pulp with higher quality it is now conventional in the bleaching sequence to apply a so called cold alkalization step, which means that the usually finish-bleached pulp is treated with NaOH at a concentration of 80–110 g/l at a temperature of 20°–30° C. During this treatment the cellulose fibres swell heavily and a great portion hemicellulose is dissolved. R18-values of 97–99% may be reached, which is very high.

When the pulp is neutralized and washed after the cold alkali refinement the fibre will shrink again. Two new features now however are introduced into the fibre:

The fibre is no longer straight but bent and curled; the fibre wall also has become more porous. Therefore the fibre will swell and increase its dimension much faster and much more when it again is brought into contact with highly concentrated alkaline solution than a not cold refined fibre.

In the case of viscose cellulose production the pulp after drying is cut into sheets with dimensions fitting in the mercerizing presses of the viscose factory. The pulp sheets are arranged vertically in the mercerizing presses whereupon 18% NaOH solution is pumped in from underbeneath. The sheets swell heavily at the same time as they are increasingly weakened. One aims at pumping in the sodium hydroxide solution at such a rate that the surface of the liquor permanently will lie 2–3 mm below the front of the liquor which is sucked up into the sheets. To the extent the sheets swell more the supply of liquor to the front from underbeneath via the space between the sheets is increasingly shut off. The supplied liquor therefore can pass into the central parts of the package of the sheets only in the "ditch" which is formed between the sheets as long as the sheets are thin in their dry or still unswelled portion above and just below the surface of the liquor, respectively, and thick in their swelled portion at greater depths. If the front will exceed upwards faster than the rate with which the liquor may flow to the narrow ditches there will be obtained a lower liquor level in the central portion of the sheets than outside the package. In other words one will obtain an increasing dynamic capillary rise. When the solution get poorer and poorer in NaOH, which will occur when the dynamic capillary rise is great, and the NaOH concentration is reduced to below 180 g NaOH/l, the swelling of the sheets will increase heavily as cellulose has its maximum swelling capacity at about 100 g NaOH/l. Therefore the spaces between the sheets will be more and more blocked for the liquor and eventually one can reach a catastrophic situation.

Because of the cold refining treatment of the cellulosic pulp the pulp will obtain considerable elasticity. The pulp mills therefore have been forced to install large, energy consuming refiners for beating the pulp prior to the pulp dryer. The pulp mills also have been forced to install very large and expensive smothing presses in the pulp drying machines as well as large baling presses. In spite of these large investment costs one has however still to meet great technical problems. If the pulp is beaten too much prior to the pulp dryer there is formed crill, which will cause impaired dewatering capacity and low production on the pulp dryer, as well as bad pressability and hence low production in the viscose factories.

DISCLOSURE OF INVENTION

The aim of the invention is to eliminate or to reduce the above mentioned drawbacks of the present technique for production of highly qualified dissolving pulp. More particularly the invention aims at essentially achieving the following advantages:

To reduce the energy consumption for beating purposes in the pulp mill considerably as compared to conventional beating prior to the pulp dryer.

To produce cracks in the secondary layer which will reduce the capillary forces of the finished sheet and may reduce the supply rate of the lye in the viscose factory.

To split the primary layer of the fibre and the outer parts of the secondary layer substantially without fibrillation so that underlaying secondary layer partially is exposed in order to increase the reactivity of the pulp bringing about improved filterability and/or reduced chemical consumption.

To produce pulp sheets with more even web formation.

To eliminate or substantially reduce the content of crill in the pulp by minimizing fibrillation in the primary layer of the fibre.

To improve the drainability in the drying machine.

To improve the pressability in the pulp drying machine.

To reduce the need of smothing pressing in the pulp dryer.

To reduce the swelling tendency and hence to improve the mercerizing features in the viscose factory.

To simplify and preferably to eliminate the dialyse of the mercerisation liquor in the viscose factory through increased refinement degree.

To be able to produce a pulp with improved mercerisation features as compared to previous grades.

To increase drainability and capacity of the steeping presses.

To increase reactivity of the pulp and to decrease consumption of $CS_2$.

These and other advantages can be achieved therein that pre-hydrolized sulphate cellulose is mechanically worked in swelled condition in a cold alkali refinement stage, e.g. in an alkaline aqueous solution, containing OH carrying cation in a concentration, which in the case of NaOH, corresponds to 50–150, preferably 70–110, g NaOH/l solution, at a supply of net-energy in the form of mechanical splitting and cracking work of 10–150, preferably 15–100, and suitably 20–60 KWh/ton pulp and at a temperature of 10°–60° C. of introduced solution, whereupon the pulp is returned to conventional processing line for i.a. washing and drying. The fibre concentration in the alkaline solution is preferably 2–35 weight-%. Suitably the concentration is at least 5% but suitably not more then 15%, since at higher concentrations the $R_{18}$ -value has a tendency to decrease. Further features and advantages of the invention will be apparent from the following description of performed experiments.

BRIEF DESCRIPTION OF DRAWINGS

The invention will be explained in the following with reference to the accompaning drawings, in which.

DESCRIPTION OF PERFORMED EXPERIMENTS

The mercerisation features of a viscose pulp sheet can be described by means of so called floating tendency and swelling curves which have the form of diagrams where floating tendency and swelling are plotted along the vertical axis and the speed of rise of external lye (sodium hydroxide solution) level are plotted along the horizontal axis. If the sheet after the mercerisation has a lower density than the mercerisation lye the sheet will float like an iceberg such that the upper part of the sheet will never be mercerized which would cause a disaster in a viscose factory. If the density of the sheet on the other hand is greater than the density of the mercerisation lye the sheet will sink, or in reality remain standing on the bottom of the mercerisation press below the lye surface.

During the experiment there was used a container in the form of a graduated cylinder. The volume was about 1 liter. The container was filled with a lye containing 180 g NaOH/l corresponding to the common concentration of the mercerisation lye in a viscose factory. The equipment also includes devices provided to lower the sheets with various constant rates into the lye. In the present examples it is possible in this manner to obtain the rates 2.5, 4.0, 6.5, 10.0 and 15 cm/min. During the period of time when the sheets are being submerged into the lye the new density (=the tendency to sink or to float, the so called floating tendency) are read on an aerometer. Thereafter the sheets are raised from the lye and weighed. The weight is compared with the weight of the dry sheet from which is calculated "specific swelling". As regards the concepts of swelling and floating tendency it is also referred to E. Ringström and N. H. Apler in "Svensk Papperstidning" No. 21, 1948 and to SCAN-C 20:64.

Figure 1:
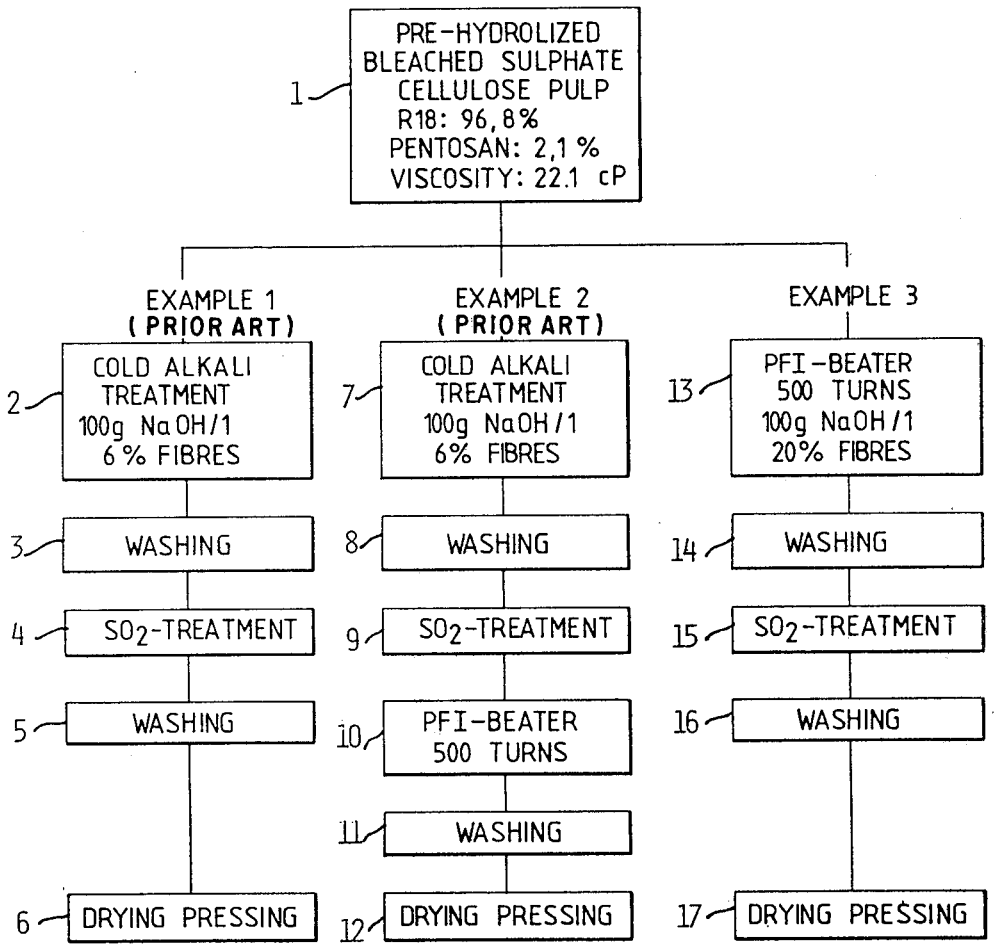
FIG. 1 in the form of a block diagram illustrates the performed experiments.

The procedure during the three experiments which have been performed are illustrated in FIG. 1. In all the three cases one has started from pre-hydrolyzed sulphate pulp, which is represented through block 1. More particularly the pulp consisted of a sulphate cellulose made from pine (pinus silverstris) with minor contents of spruce (picea abies). The pre-hydrolisation was performed through cooking with water dissolving out about 20% of the wood material, whereupon has followed a conventional sulphate cooking. Thereafter the cellulose has been bleached in a manner which is conventional for cord pulp. The features of this material, which constitutes the starting material during the experiments, can be summarized in the following way:

R18-value: 96.8%;

Pentosan content: 2.1%;

Viscosity: 22.1 cP (Tappi).

According to Example 1 this pre-hydrolized sulphate pulp, which essentially consists of natural, i.e. chemically non-transformed cellulose (ca 80–90 weight-%) and residual amounts of chemically non-transformed hemicellulose (ca 10–20 weight-%) was cold alkali treated in an aqueous solution containing 100 g NaOH/l. The fibre concentration was 6%, see block 2. The cold alkali treated pulp thereafter was washed, block 3, pH adjusted through addition of $SO_2$ water, block 4, again washed, block 5, whereupon the pulp was dryed and pressed in a manner which is typical for cord pulp, block 6.

Example 2 illustrates a conventional method for the production of cord cellulose pulp. The pre-hydrolized sulphate pulp 1 is cold alkali treated, 7, in the same manner as according to block 2 in Example 1, washed 8, $SO_2$ treated 9, whereupon the pulp was subjected to beating in a PFI-beater, 10, with a net energy supply in the form of 500 turns. The mechanical working was performed in water at a fibre concentration of about 10%. After beating the pulp was washed, 11, and dryed and pressed, 12, in a manner identical to that according to Example 1.

Example 3 illustrates the present invention. According to the example the pre-hydrolized sulphate cellulose l was subjected to mechanical working in a PFI-beater in an alkaline environment. According to the example the solution contained 100 g NaOH/l. The energy transfer from the PFI-beater corresponded to 500 turns, and the fibre concentration in this example was 20%. The mechanical working is illustrated through block 13. After this mechanical working 13 the pulp was washed 14, $SO_2$ treated for neutralization 15, again washed 16, and dryed and pressed 17 in a manner which is identical to that in Examples 1 and 2.

Figure 2:
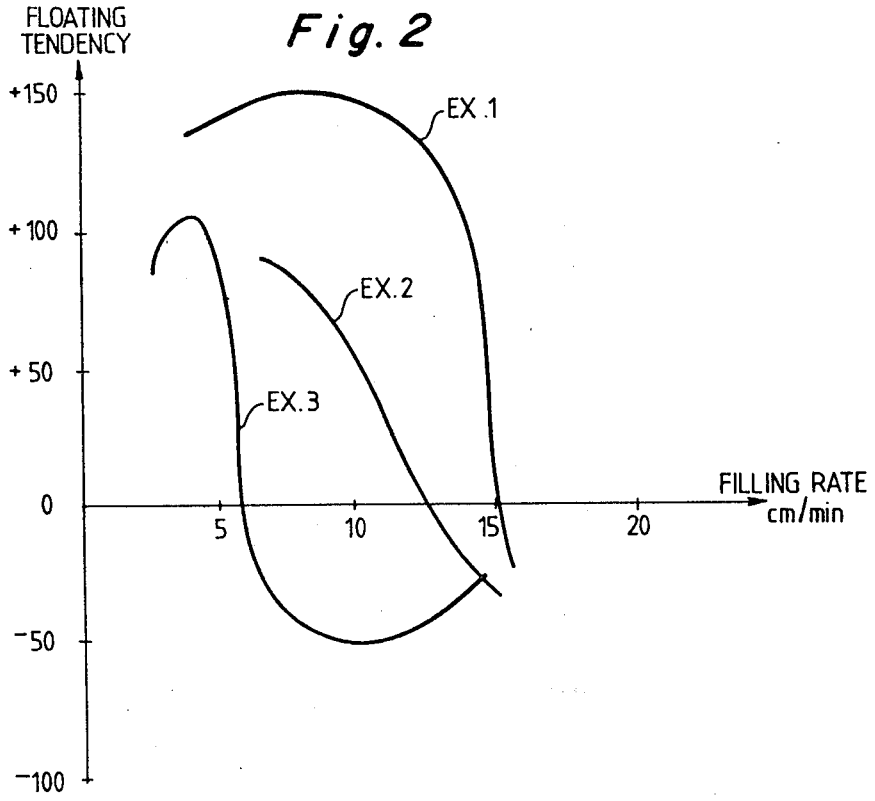
FIG. 2 in the form of a diagram shows so called floating tendency curves.
Figure 3:
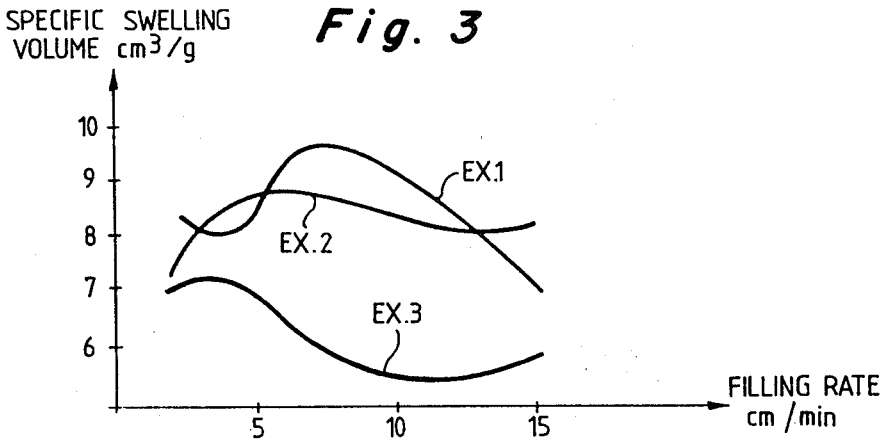
FIG. 3 shows so called swelling curves.

The pulp samples obtained in the above described examples thereafter have been analysed in the manner above described. The test results are apparent from Table 1–3. These results also are illustrated in the form of diagrams in FIGS. 2 and 3. From the diagrams in FIG. 2 it is seen that the floating tendency curve in a favourable manner has been displaced downwards and to the left at the method of the invention at the same time as also the swelling curve has been developed in a very favourable manner. Due to the favourable positions of the floating tendency curves in Example 3, there will be good opportunities in the viscose factory very accurately to control the mercerisation conditions. Owing to the swelling the capacity of the mercerisation presses will be increased. The achieved results also indicate that, as an alternative, instead of taking advantage of the improved mercerisation features, one can increase the refining degree of the pulp which may reduce or even eliminate the need for dialysis of the mercerisation lye.

Further the dewatering ability of the fibres has been improved through the invention. The drying features for samples produced in Examples 2 and 3 have been stated in Table 4. Because of the very bad mercerisation features of the pulp produced according to Example 1, this pulp is considered uninteresting and its drying features therefore have not been evaluated. The measurements have been made by means of a Shopper-Riegler freeness tester and has been performed such that the "freeness" 2, 4, 6, and 8 gram samples have been tested in the apparatus.

Table 4 shows that the pulp according to the invention will drain off a larger volume water than the reference material and may do that during a shorter period of time which gives an increased capacity to the pulp drying machine. Further Tables 2 and 3, last column, show that the pulp can be pressed to a higher density than the reference material, which condition also concerns the presses in the drying section of the machine, which means that the invention further may increase the dryness of the pulp transferred to the drying section of the pulp mill.

TABLE 1

Example 1

Floating tendency and specific swelling volume

| Filling rate cm/min | Dynamic capillary rise, mm | Aerometer $b_0$ | Aerometer $b_1$ | Aerometer $b_1 - b_0$ | Floating tendency $\frac{K(b_1 - b_0)}{G \cdot t}$ | Weight, g Air Dry G | Weight, g Ack C C | Specific swelling volume $\frac{C}{1,2 \cdot G \cdot t}$ | Micrometer mm a | Density $\frac{10 \cdot G}{A \cdot a}$ |
|---|---|---|---|---|---|---|---|---|---|---|
| | | | | | | 3.85 | | | 5.77 | 0.82 |
| 2.5 | 27 | 1.161 | floating | — | — | | 7.70 | 67.0 | 8.48 | |
| | | | | | | 3.85 | | | 5.33 | 0.89 |
| | | | | | | 3.87 | | | 5.20 | 0.92 |
| 4.0 | 25 | | 1.194 | 0.032 | 138 | | 7.55 | 67.9 | 8.24 | |
| | | | | | | 3.68 | | | 5.08 | 0.90 |
| | | | | | | 3.74 | | | 5.88 | 0.79 |
| 6.5 | 17 | | floating | — | — | | 7.35 | 67.2 | 9.77 | |
| | | | | | | 3.61 | | | 5.81 | 0.77 |
| | | | | | | 3.56 | | | 5.50 | 0.80 |
| 10 | 13 | | 1.189 | 0.028 | 147 | | 7.05 | 62.0 | 9.16 | |
| | | | | | | 3.49 | | | 5.36 | 0.80 |
| | | | | | | 3.81 | | | 5.16 | 0.91 |
| 15 | | | 1.160 | −0.001 | −4 | | 7.53 | 59.0 | 7.30 | |
| | | | | | | 3.72 | | | 5.25 | 0.88 |
| | | | | | | | | | | Mv 0.85 |

K = 29.6
A = 0.809

TABLE 2

Example 2

Floating tendency and specific swelling volume

| Filling rate cm/min | Dynamic capillary rise, mm | Aerometer $b_0$ | Aerometer $b_1$ | Aerometer $b_1 - b_0$ | Floating tendency $\frac{K(b_1 - b_0)}{G \cdot t}$ | Weight, g Air Dry G | Weight, g Ack C C | Specific swelling volume $\frac{C}{1,2 \cdot G \cdot t}$ | Micrometer mm a | Density $\frac{10 \cdot G}{A \cdot a}$ |
|---|---|---|---|---|---|---|---|---|---|---|
| | | | | | | 3.77 | | | 5.18 | 0.90 |
| 2.5 | 27 | 1.161 | floating | — | — | | 7.39 | 63.3 | 7.98 | |
| | | | | | | 3.62 | | | 5.05 | 0.89 |
| | | | | | | 3.65 | | | 5.61 | 0.80 |
| 4.0 | 24 | | floating | — | — | | 7.55 | 65.8 | 8.65 | |
| | | | | | | 3.90 | | | 5.50 | 0.88 |
| | | | | | | 3.47 | | | 5.01 | 0.86 |
| 6.5 | 16 | | 1.180 | 0.019 | 89 | | 7.12 | 68.0 | 8.94 | |
| | | | | | | 3.65 | | | 4.91 | 0.92 |
| | | | | | | 3.56 | | | 4.92 | 0.90 |
| 10 | 4 | | 1.170 | 0.009 | 47 | | 6.88 | 59.1 | 8.62 | |
| | | | | | | 3.32 | | | 5.38 | 0.76 |
| | | | | | | 3.30 | | | 5.53 | 0.74 |
| 15 | | | 1.155 | −0.006 | −34 | | 6.65 | 52.6 | 8.38 | |
| | | | | | | 3.35 | | | 5.02 | 0.83 |
| | | | | | | | | | | Mv 0.85 |

K = 29.6
A = 0.809

TABLE 3

Example 3
Floating tendency and specific swelling volume

| Filling rate cm/min | Dynamic capillary rise, mm | Aerometer $b_0$ | $b_1$ | $b_1 - b_0$ | Floating tendency $K(b_1 - b_0)/G \cdot t$ | Weight, g Air Dry G | Ack C C | Specific swelling volume $C/1{,}2 \cdot G \cdot t$ | Micrometer mm a | Density $10 \cdot G/A \cdot a$ |
|---|---|---|---|---|---|---|---|---|---|---|
| | | | | | | 3.82 | | | 4.86 | 0.97 |
| 2.5 | 21 | 1.161 | 1.182 | 0.021 | 84 | | 7.63 | 64.6 | 7.31 | |
| | | | | | | 3.81 | | | 4.90 | 0.96 |
| | | | | | | 3.65 | | | 4.89 | 0.92 |
| 4.0 | 13 | | 1.185 | 0.024 | 106 | | 7.26 | 59.3 | 7.36 | |
| | | | | | | 3.61 | | | 4.81 | 0.93 |
| | | | | | | 3.88 | | | 4.80 | 1.00 |
| 6.5 | 3 | | 1.154 | −0.007 | −27 | | 7.70 | 58.6 | 6.37 | |
| | | | | | | 3.82 | | | 4.76 | 0.99 |
| | | | | | | 4.06 | | | 4.84 | 1.04 |
| 10 | | | 1.148 | −0.013 | −48 | | 7.83 | 54.2 | 5.66 | |
| | | | | | | 3.77 | | | 4.65 | 1.00 |
| | | | | | | 3.92 | | | 5.07 | 0.96 |
| 15 | | | 1.156 | −0.005 | −20 | | 7.70 | 50.8 | 5.76 | |
| | | | | | | 3.78 | | | 4.91 | 0.95 |
| | | | | | | | | | | Mv 0.97 |

K = 29.6
A = 0.809

TABLE 4

Dewatering in Shopper-Riegler Tester

| | Sample quantity: grams 2 | | 4 | | 6 | | 8 | |
|---|---|---|---|---|---|---|---|---|
| | Ex 3 | Ex 2 | Ex 3 | Ex 2 | Ex 3 | Ex 2 | Ex 3 | Ex 2 |
| Dewatering time, SR | 9 | 10 | 13 | 16 | 16 | 17 | 17 | 18 |
| Reading, value | 12.5 | 13.0 | 20.5 | 22.0 | 28.5 | 29.0 | 33.0 | 35.0 |
| Wet weight, grams | 70.0 | 71.0 | 135.1 | 138.7 | 191.1 | 206.7 | 244.9 | 260.0 |
| Dry weight, grams | 2.0 | 2.0 | 4.18 | 4.18 | 6.38 | 6.28 | 8.36 | 8.38 |
| Grammage | 177 | 177 | 369 | 369 | 564 | 556 | 740 | 742 |
| $m^3$ water per ton pulp to dry with steam | 37.8 | 38.3 | 34.8 | 35.8 | 32.2 | 35.5 | 31.4 | 33.4 |

Figure 4:
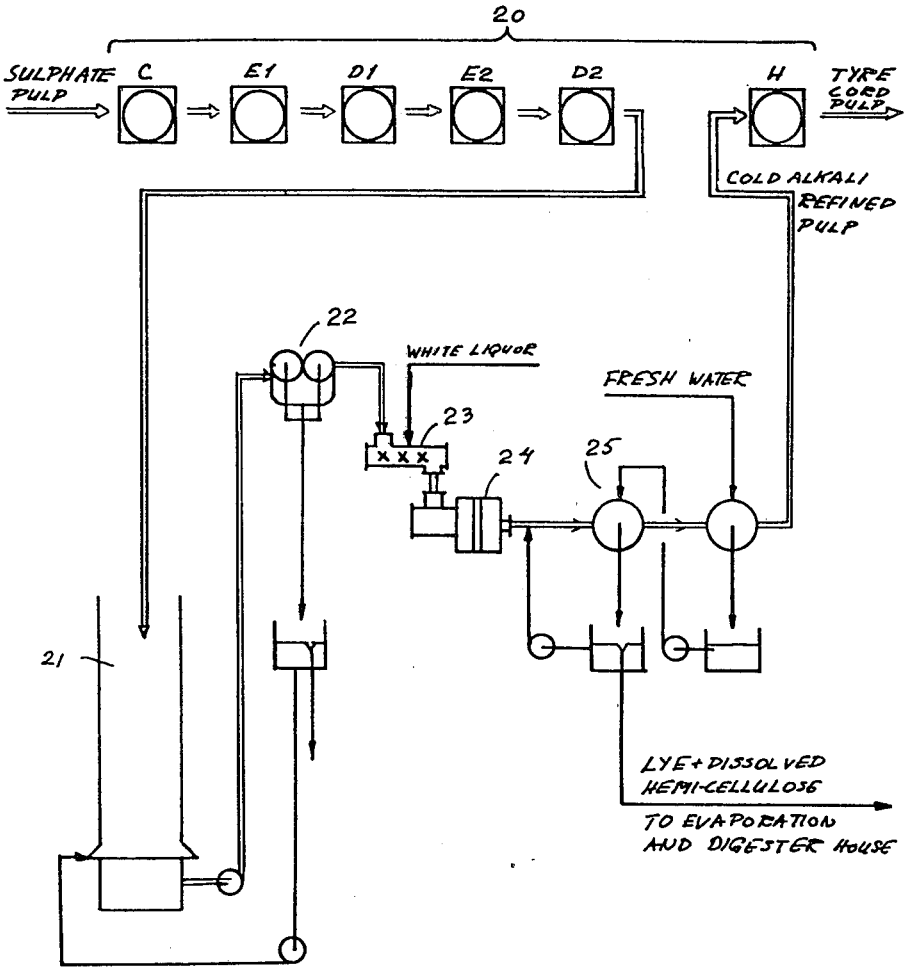
FIG. 4 illustrates schematically in the form of a flowchart how the method can be carried out in practice in accordance with a preferred embodiment of the invention.

Referring now to FIG. 4 a sulphate pulp bleaching plant for the production of tyre cord pulp is shown as 20. The bleaching sequence consists of chlorination C, first alkali extraction E 1, first chlorine dioxide bleaching D 1, second alkali extraction E 2, second chlorine dioxide bleaching D 2, and a final hypchlorite treatment H. The pulp from the second chlorine dioxide stage D 2 is fed to a buffer storage 21 and therefrom (optionally) to a dewatering press 22. In a mixer 23 the pulp having the desired concentration is mixed with white liquor (or with NaOH) to desired alkali concentration according to the invention, whereupon the cold mixture is subjected to beating according to the invention in a disc refiner 24. After working in the disc refiner the prescribed energy supply the pulp is fed to a washing plant 25 for removing lye from the fibres. The lye and hemicellulose which has been dissolved during the cold alkali working in the disc refiner 24 is conveyed to an evaporation and digester house, while the cold alkali refined cellulose pulp is recycled to the bleaching plant for final treatment in the H-stage to obtain a finished cold alkali refined tire cord pulp having improved properties according to the preferred embodiment of the invention.

We claim:

1. In a process for producing a highly qualified dissolving pulp sheet comprising removing a substantial proportion of the hemicellulose in a pre-hydrolyzed, bleached sulphate cellulosic pulp consisting essentially of natural, non-chemically transformed cellulose and residual amounts of non-chemically transformed hemicellulose by contacting said pulp with an alkaline aqueous solution of sodium hydroxide to treat same, said solution containing 50–150 g NaOH/l, and being at a temperature of about 10° to 60° C., thereafter washing the treated pulp to remove sodium hydroxide and dissolved hemicellulose therefrom, and drying and pressing the washed, treated pulp to form sheets, the improvement comprising subjecting the pulp during at least a portion of the treatment step to mechanical working under a net energy supply of 15–100 KWh/ton pulp to split the primary layer, and at least the outer parts of the secondary layer, of the pulp fibers substantially without fibrillation, whereby the pulp sheet exhibits reduced swelling tendencies and improved mercerizing properties, combined with at least reduced need for dialysis of the mercerisation liquor, in subsequent viscose processing, while reducing the energy consumption in the treatment process.

2. Process of claim 1, wherein the alkaline aqueous solution container 70–110 g NaOH/l.

3. Process according to claim 1, wherein the net energy supplied to said pulp by said mechanical working is 20–60 KWh/ton pulp.

4. Process of any one of claims 1, 2 or 3, wherein the concentration of the cellulosic pulp in the alkaline aqueous solution is about 2 to about 35 weight percent.

5. Process of claim 4, wherein said concentration is about 5 to about 15 weight percent.

6. Process of claim 4, wherein the cellulose fibers of the pulp sheet have an R18 value of 97–99%.

7. Process of claim 4, wherein the pulp is subjected to mechanical working in a disc refiner.

8. Process of claim 8, wherein said pre-hydrolyzed, bleached sulphate cellulosic pulp contains about 80–90 weight percent of chemically non-transformed cellulose and about 10–20 weight percent of chemically non-transformed hemicellulose.

* * * * *